US005533862A

United States Patent [19]

Jung

[11] Patent Number: 5,533,862

[45] Date of Patent: Jul. 9, 1996

[54] BLOWER HAVING PROPELLER FAN POSITIONED AXIALLY AND RADIALLY WITH RESPECT TO A SURROUNDING SHROUD FOR QUIETER FAN OPERATION

[75] Inventor: Seung-Taeg Jung, Kwangmyoung, Rep. of Korea

[73] Assignee: Samsung Electronics Co., Ltd., Suwon, Rep. of Korea

[21] Appl. No.: 264,077

[22] Filed: Jun. 22, 1994

[30] Foreign Application Priority Data

Apr. 18, 1994 [KR] Rep. of Korea ..... 1994-8100

[51] Int. Cl.[6] ..... F04D 19/00

[52] U.S. Cl. ..... 415/220

[58] Field of Search ..... 415/220; 416/189 R

[56] References Cited

U.S. PATENT DOCUMENTS

| | | | |
|---|---|---|---|
| 4,061,188 | 12/1977 | Beck | 415/220 X |
| 4,173,995 | 11/1979 | Beck | 415/220 |
| 4,459,087 | 7/1984 | Barge | 416/189 R |
| 4,548,548 | 10/1985 | Gray, III | 416/189 R |
| 4,927,328 | 5/1990 | Scoates et al. | 415/220 |
| 5,217,351 | 6/1993 | Meier et al. | 415/220 X |

*Primary Examiner*—Edward K. Look
*Assistant Examiner*—Michael S. Lee
*Attorney, Agent, or Firm*—Burns, Doane, Swecker & Mathis

[57] ABSTRACT

An air blower comprises a rotary fan having an array of radial blades, and a stationary bell mouth arranged in coaxial encircling relationship to an outer periphery of the blade array. Each blade includes an upstream side, and the bell mouth includes an upstream side. A radially inner end of the upstream side of the bell mouth is coplanar with radially outer ends of the upstream sides of the blades.

4 Claims, 5 Drawing Sheets

FIG. 1
(PRIOR ART)
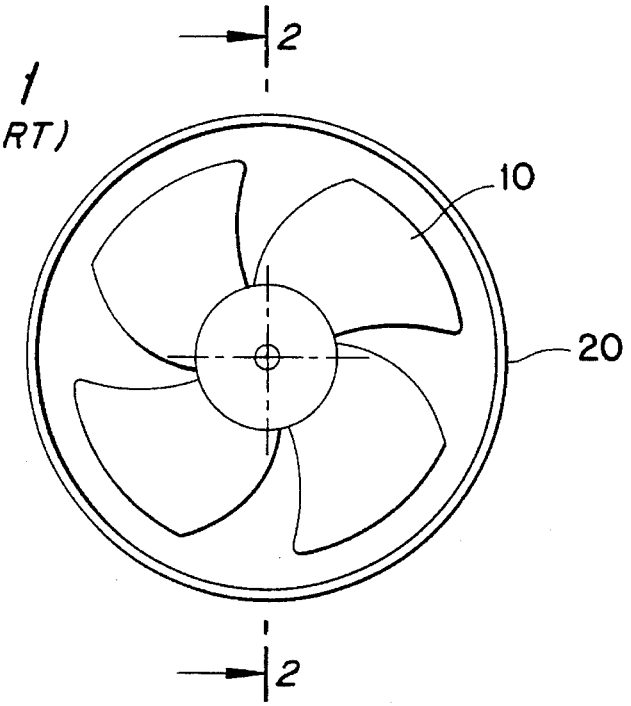
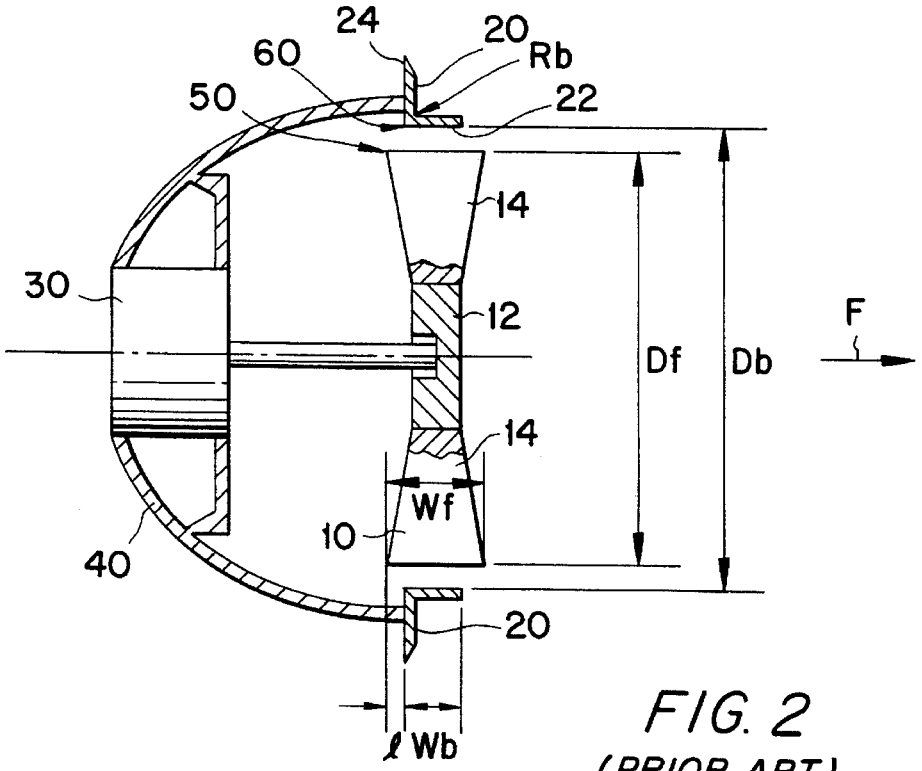
FIG. 2
(PRIOR ART)

BLOWER HAVING PROPELLER FAN POSITIONED AXIALLY AND RADIALLY WITH RESPECT TO A SURROUNDING SHROUD FOR QUIETER FAN OPERATION

BACKGROUND OF THE INVENTION

1. Field of the Invention

The present invention relates to a low noise blower for a heat exchanger.

A propeller fan is usually used for blowing air for performing a heat exchange operation in appliances such as a refrigerator, an outdoor device of an air conditioner, a computer and the like.

Air at an exit side in the propeller fan, unlike that of a genuine axial fan, is discharged at a predetermined angle relative to the axis of rotation of the propeller.

Furthermore, because the propeller fan is mainly used for an appliance having a predetermined circulation route of the air, a shroud or bell mouth is installed around a periphery of the propeller fan in order to define an air circulation route at the exit of the fan and to improve the performance of the fan.

FIGS. 1 and 2 are drawings for illustrating a conventional blower having a propeller fan 10 and a bell mouth 20 wherein FIG. 1 is a front view and FIG. 2 is a side sectional view.

As described above, the conventional blower comprises: a motor 30 for receiving power from an electrical power source; a propeller fan 10 for being rotated by the motor 30; a bell mouth 20 for encompassing the periphery of the propeller fan 10; and a bracket 40 for supporting the motor 30 and fixed to the bell mouth 20. The fan 10 includes a hub 12 and an array of radial blades 14.

Accordingly, when the motor 30 is activated, the propeller fan 10 starts rotating and creates an air flow F.

When the propeller fan 10 is rotated, the air at an entrance of the bell mouth 20 (left side thereof in FIG. 2) is increased in pressure by centrifugal force and buoyancy to thereby be discharged toward an exit (to the right in FIG. 2).

At this time, the sound (blade rotating sound) of the fan 10 and an air flow operational noise, including air noise of a broad band, emanate from the blower.

Meanwhile, one of the most important factors in determining the performance and noise of the blower is the design of the propeller fan 10, along with the design of the bell mouth 20.

In other words, in order to obtain high efficiency and low noise operation of the propeller fan 10, the construction of the bell mouth 20 with respect to an outer diameter and a width thereof are major design factors, along with the design of the fan blades.

Furthermore, an assembled structure of the fan 10 to the bell mouth 20 is an important factor in determining the performance and noise reduction of the blower.

The above drawing illustrates the important design factors of the fan 10 and bell mouth 20.

In other words, the outer diameter Df and the width Wf of each blade are important factors in designing the fan 10, and an inner diameter Db, a width Wb and a curvature Rb of the bell mouth 20 are illustrated as important factors in designing the bell mouth 20. The curvature Rb is between axial and radial sections 22, 24 of the bell mouth.

Furthermore, a distance l between starting points (i.e., upstream ends) 50, 60 of the fan 10 and the bell mouth 20 is illustrated in the drawing as an important factor in determining the performance and the noise of the blower.

The performance and noise of the blower can be changed by varying the design factors thus described. However, heretofore there has been no optimization of the inner diameter Db, width Wb and the curvature Rb of the bell mouth 20 the outer diameter Df and the width Wf of the propeller fan 10, so a considerable amount of air flow loss generated during the operation of the blower has occurred.

Furthermore, the assembled structure of the fan 10 to the bell mouth 20 plays an important role in determining the performance and the noise of the blower, and an optimum relation thereof has not been established so far, which has limited realization of high performance and low noise of the blower.

In other words, the axial distance l between end points on the fan 10 and the bell mouth 20 is an important factor in determining the performance and the noise of the blower and not heretofore been clearly defined, which has thereby caused a decreased efficiency and increased operational noise.

The performance and noise such as the blowing quantity and the like can be measured by experimentally.

In the case of a conventional blower, the blowing quantity (air flow) is measured as being less than approximately $1.9338\times10$ $m^3$/sec and the noise is measured as more than approximately 26.1 dB(A).

SUMMARY OF THE INVENTION

The present invention has been provided to solve the above-mentioned problems, and it is an object of the present invention to provide a low noise blower whose design of a propeller fan and a bell mouth is such as to achieve a high efficiency of the blower and a low-noise operation of the same.

In accordance with the object of the present invention, there is provided a low noise blower comprising: a propeller fan for receiving electrical power to be rotated; and a bell mouth for being disposed around a periphery of the propeller fan and having an optimum design in relation to the propeller fan.

BRIEF DESCRIPTION OF THE DRAWINGS

For a better understanding of the nature and objects of the invention, reference should be made to the following detailed description taken in conjunction with the accompanying drawings in which:

FIG. 1 is a front view of a conventional blower;

FIG. 2 is a sectional view of the conventional blower taken along line 2—2 in FIG. 1;

DETAILED DESCRIPTION OF THE PREFERRED EMBODIMENT OF THE INVENTION

In order to provide a blower of lower noise emittance and high performance, the present invention involves calculating optimum dimensional ratios in the propeller fan 10 and the shroud or bell mouth 20.

In other words, the present invention considers different ratios of an inner diameter Db, a width Wb and a curvature Rb in the bell mouth 20, a width Wf of the blade, an outer diameter of the fan 10, while repeatedly measuring the noise, so that ratios are calculated relating to the configurations of the bell mouth 20 and the fan 10 for creating a blower of low noise and high efficiency.

First of all, ratios Db/Df are varied while measuring the noise.

Figure 3A:
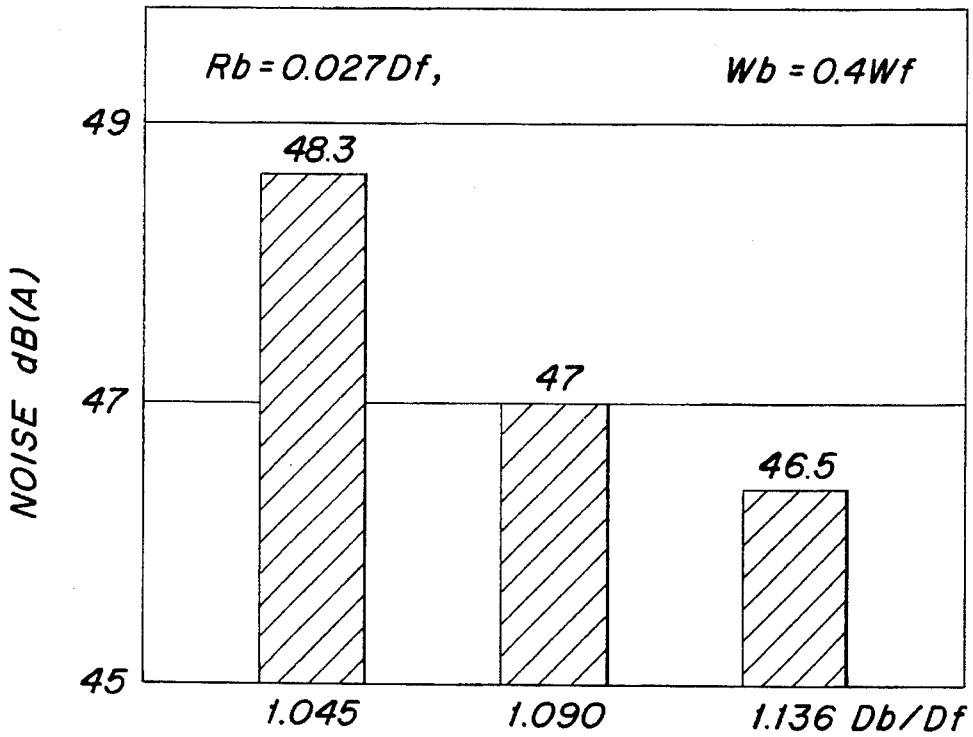
FIGS. 3*a* and 3*b* are graphs for illustrating measured values of noise levels as a function of a ratio of an outer diameter Df of a fan to an inner diameter Db of a bell mouth.
Figure 3B:
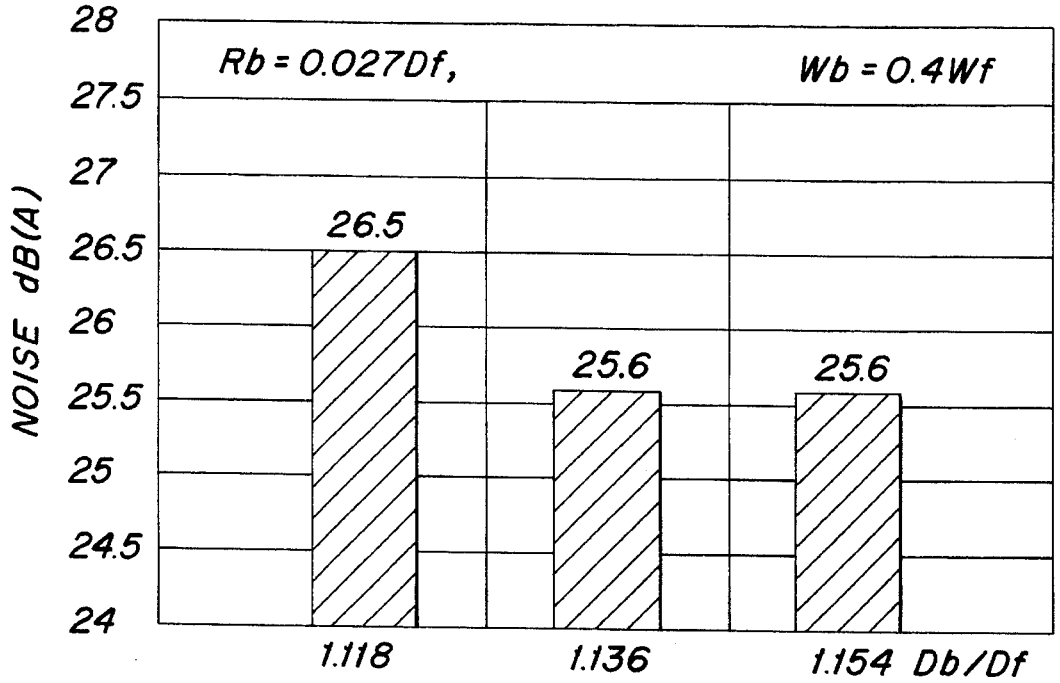

The measured noise results obtained from varying the ratios Db/Df are illustrated in the graphs of FIGS. 3*a* and 3*b*, wherein the noise results are on the ordinate of the graph, and the Db/Df ratios are on the abscissa.

According to FIG. 3*a*, the ratio Rb/Df is 0.027, and the ratio Wb/Wf is 0.4.

In the meantime, the noise has been measured by varying the ratio Db/Df.

As a result the noise has been measured as 48.3 dB(A) when the ratio Db/Df is 1.045; the noise is 47.0 dB(A) when the ratio Db/Df is 1.090; and the noise is 46.5 dB(A) when the ratio Db/Df is 1.136.

As a result therefrom, the noise was the lowest when the ratio Db/Df was 1.136.

Accordingly, the noise has then been measured when the ratio Db/Df is 1.118 and 1.154 in order to measure the noise in more detail as shown in FIG. 3*b*, after a predetermined sound shielding board was established in front of the blower.

In other words, the predetermined sound shielding board was installed to act as a damper cover in a manner similar to a sound shielding board in a refrigerator.

The noise measurements were 26.5, 25.6, and 25.6 when, after the sound shielding board was installed, the ratios Db/Df were 1.118, 1.136 and 1.154, respectively.

As seen from the foregoing, it should be noted that the noise was lowest when the ratios Db/Df were 1.136 and 1.154 respectively.

It was noted that, even though the noise tapered off when the ratio Db/Df was larger than 1.154, the noise decrease was not enough to be worth consideration.

When it is considered that the bell mouth 20 functions to smoothly guide the air from the entrance side of the propeller fan 10 towards the exit side and functions to prevent the air at the exit side from flowing backward to the entrance side, it should be apparent that it is no longer worthwhile to enlarge the ratio Db/Df.

Accordingly, it is advisable to set the ratio of the inner diameter Db/Df at 1.15±0.02.

As noted above, the noise level was measured under a state when an optimum ratio Db/Df is fixed, and the width Wb of the bell mouth 20 (which is the other major design element) is constant.

Figure 4A:
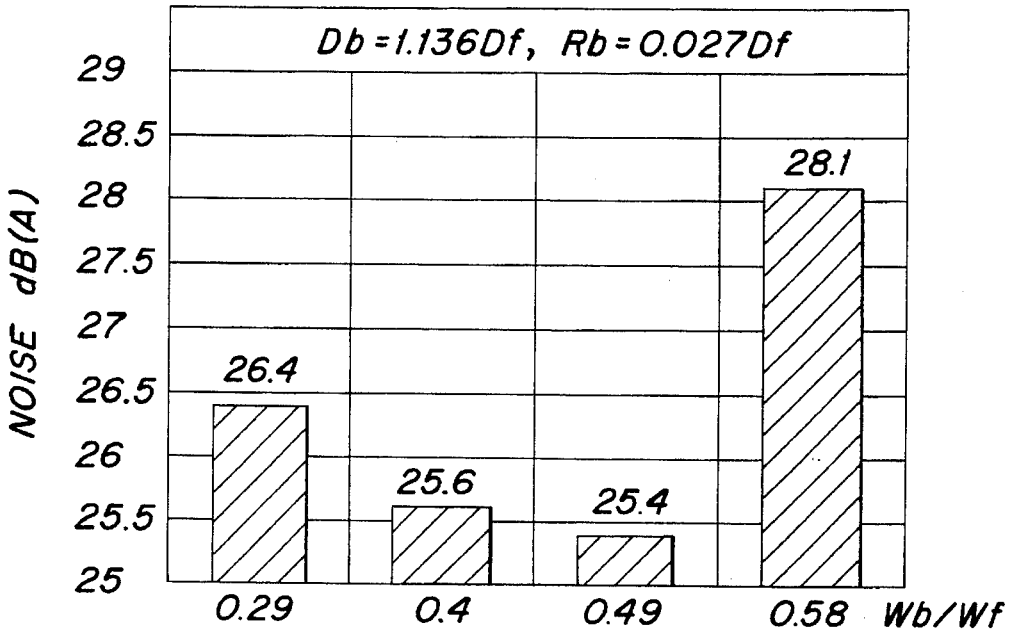
FIGS. 4*a* and 4*b* are graphs for illustrating measured values of noise levels as a function of a ratio of a width Wf of a blade in the fan to a width Wb of the bell mouth.
Figure 4B:
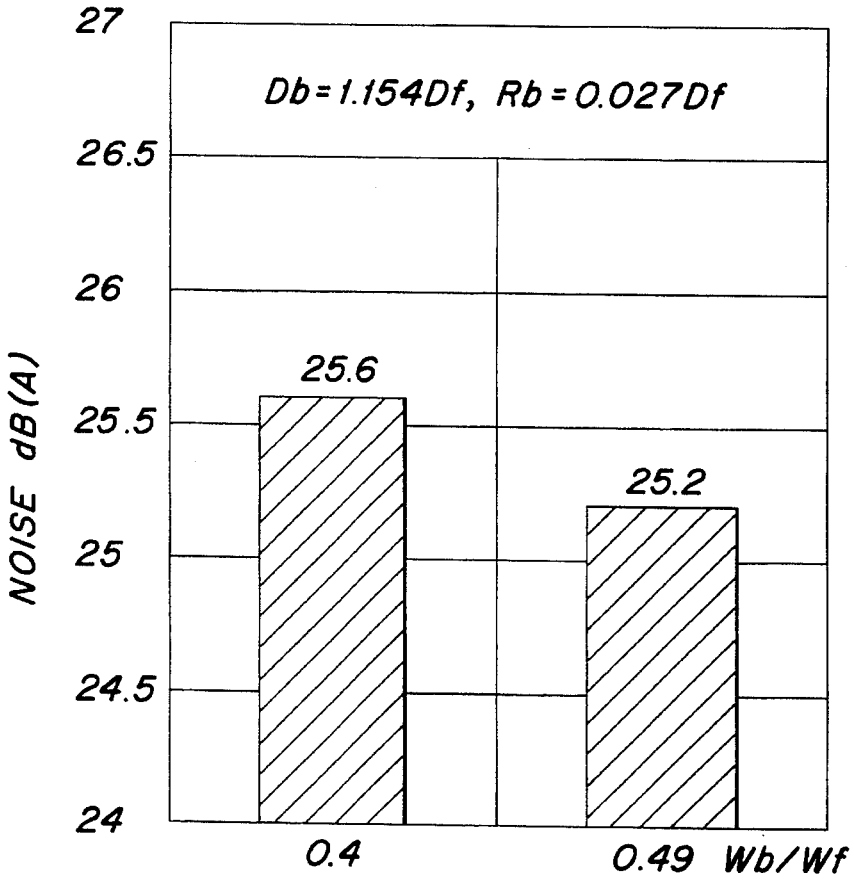

FIGS. 4*a* and 4*b* are graphs for illustrating a measured noise obtained by varying the ratio Wb/Wf (i.e., ratio of the width Wf of the fan 10 to the width Wb of the bell mouth 20) when the ratio Db/Df is set at 1.136 and then at 1.154. According to FIG. 4*a* when the ratio Db/Df is set at 1.136 and the ratio Rb/Df between the width Df of the fan 10 and the width Rb of the bell mouth 20 is set at 0.027, noise is measured by varying the ratio Wb/Wf.

At this time, the measurement was made without installment of a predetermined sound shielding board in front of the blower.

As a result, the noise was measured at 26.4 dB(A) when the ratio Wb/Wf was 0.29; the noise measurements were respectively 25.6 dB(A) and 25.4 dB(A) when the ratios Wb/Wf were 0.4 and 0.49 respectively; and the noise was measured at 28.1 dB(A) when the ratio Wb/Wf was 0.58.

According to the above results, it was noted that the noise measurements (i.e., 25.6 dB(A) and 25.4 dB(A)) were lowest when the ratios Wb/Wf were 0.4 and 0.49 respectively.

Accordingly, as shown in FIG. 4*b*, the noise was re-measured when the ratios Wb/Wf were 0.4 and 0.49 respectively, after changing the ratio Db/Df to 1.154.

At this time, the re-measurement was performed with the predetermined sound shielding board installed in front of the blower.

As a result therefrom, it was noted that the change of ratio Db/Df from 1.136 to 1.154 had little effect on noise generation.

As illustrated in FIGS. 4*a* and 4*b*, the ratio Wb/Wf should preferably be 0.468±0.068.

Figure 5A:
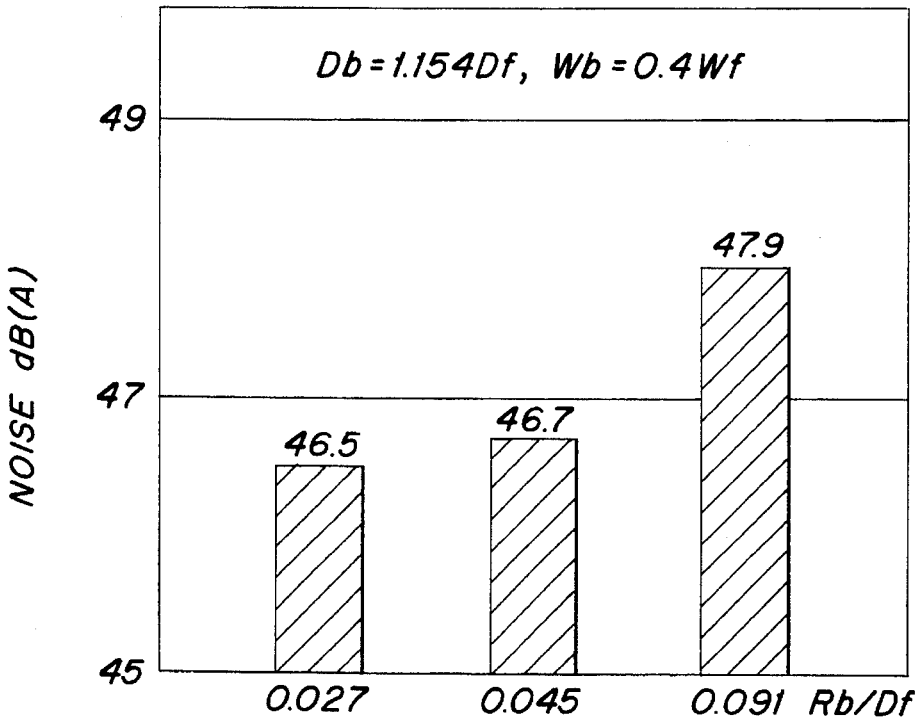
FIGS. 5*a* and 5*b* are graphs for illustrating measured values of noise levels as a function of a ratio of the outer diameter Df in the fan to a curvature Rb of the bell mouth.
Figure 5B:
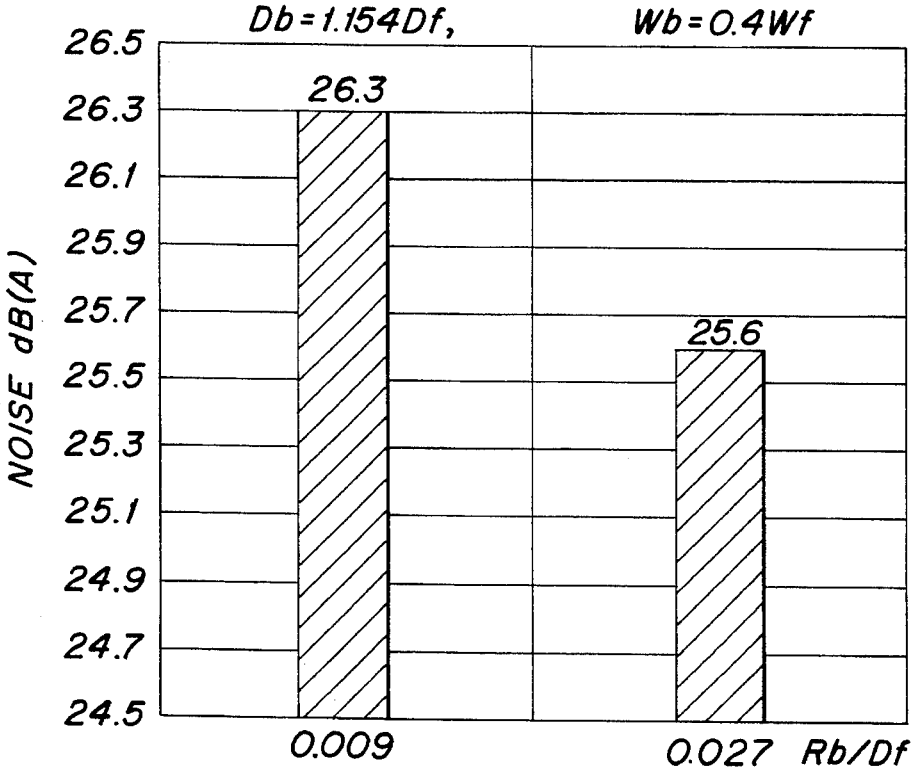

Meanwhile, FIGS. 5*a* and 5*b* are graphs for illustrating a measurement result of noise by varying the ratio Rb/Df of the outer diameter Df of the fan 10 to the curvature Rb of the bell mouth 20 when the ratio Db/Df was set at 1.154 and the ratio Wb/Wf was set at 0.4.

At this time, the measurement was performed without the predetermined sound shielding board installed in front of the blower.

According to FIG. 5*a* the noise was 47.0 dB(A) when the ratio Rb/Df was set at 0.027; the noise was 46.7 dB(A) when the ratio Rb/Df was set at 0.045; and the noise was 47.9 dB(A) when the ratio Rb/Df was set at 0.091.

As a result therefrom, the noises were lowest when the ratios Rb/Df were set at 0.027 and 0.045 respectively; and when that ratio was set at 0.091, the noise was loud.

Accordingly, as illustrated in FIG. 5*b*, the noises were measured when the ratios Rb/Df were set at 0.027 and 0.009 respectively.

At this time, the measurement was performed with the predetermined sound shielding board installed in front of the blower.

As a result therefrom, the noise was 26.3 dB(A), which is rather high, when the ratio Rb/Df was set at 0.009.

Accordingly, it was determined that the ratio Rb/Df should preferably be 0.032±0.014, and the noise was indicated high when the ratio was too low or too high.

Furthermore, a noise was also measured with reference to variations of distance l between a radially outer end 50 the entrance (upstream) side 55 of the blades of the propeller fan 10 and a radially inner end 60 of an upstream side 65 of the bell mouth 20 (i.e., upstream sides of the fan 10 and bell mouth 20), which affects the performance and noise of the blower.

Figure 6:
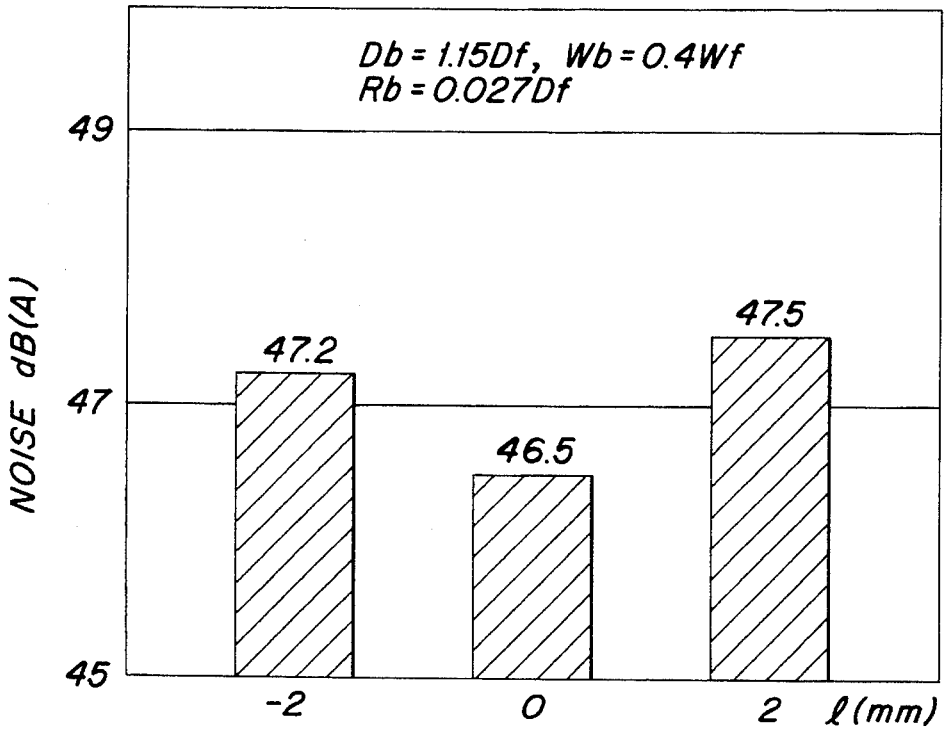
FIG. 6 is a graph for illustrating measured values of the noise levels as a function of a distance between an inlet tip of the propeller fan and an end point of the bell mouth.

FIG. 6 is a graph for illustrating measured noise levels in accordance with variations of the distance l in case of no predetermined sound shielding board installed in front of the blower. Also, the ratio Db/Df is set at 1.15, the ratio Wb/Wf is set at 0.4, and the ratio Rb/Df is set at 0.027.

According to FIG. 6, the measured noise levels were 47.2 dB(A) and 47.5 dB(A) respectively when the distances l were −2 mm and 2 mm respectively.

Figure 7:
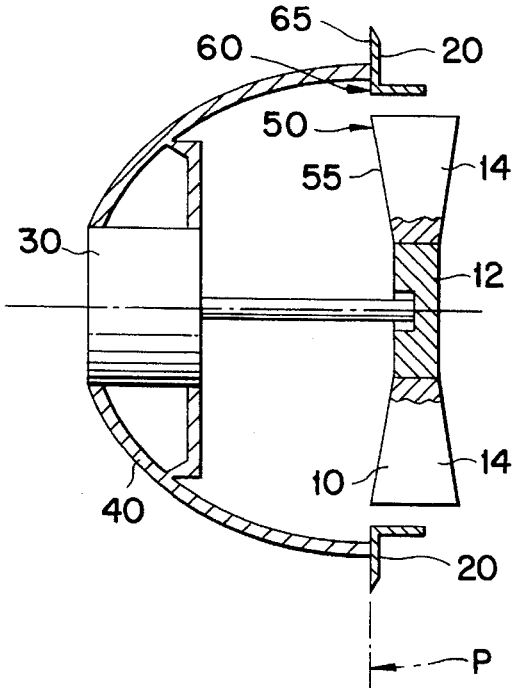
FIG. 7 is a view similar to FIG. 2 of an air blower according to the present invention.

The measured noise level of 46.5 dB(A) was the lowest when the distance l was 0 mm i.e., wherein the tip at the entrance (upstream) side 50 of the propeller fan 10 and the starting (upstream) point 60 of the bell mouth 20 lie on a common plane P as depicted in FIG. 7.

As seen from the foregoing, the present invention has obtained an effect of decreased noise levels and increased performance by relating the design factors of the bell mouth in proportion to the major design factors of the propeller fan.

The foregoing description and drawings are illustrative and are not to be taken as limiting.

Still other variations and modifications are possible without departing from the spirit and the scope of the present invention.

What is claimed is:

1. A low-noise air blower comprising:

a propeller fan rotatable about an axis for creating an air stream and including an array of radially projecting blades, each blade including an upstream side; and a stationary bell mouth coaxially encircling an outer periphery of said array of blades, said bell mouth including an upstream side;

radially outer ends of said upstream sides of said blades being coplanar with a radially inner end of said upstream side of said bell mouth;

said bell mouth including an inner diameter Db, and said array of blades defining an outer diameter Df; a ratio of Db/Df being 1.15±0.02.

2. The low-noise air blower according to claim 1, wherein said bell mouth includes an axial width Wb, and each blade of said fan has a width Wf; a ratio of Wb/Wf being 0.468±0.068.

3. The low-noise air blower according to claim 2, wherein said bell mouth includes axial and radial sections intersecting one another to define a radius of curvature Rb, and said array of blades defining an outer diameter Df; a ratio of Rb/Df being 0.032±0.014.

4. The low-noise air blower according to claim 1, wherein said bell mouth includes axial and radial sections intersecting to define a radius of curvature Rb, and said array of blades defining an outer diameter Df, a ratio of Rb/Df being 0.032±0.014.

* * * * *